United States Patent [19]

Vance

[11] 4,436,455

[45] Mar. 13, 1984

[54] UNIVERSALLY POSITIONABLE LOW PROFILE MINE DRILLING MACHINE AND METHOD

[76] Inventor: Ershell C. Vance, Box 86, Jewell Ridge, Va. 24622

[21] Appl. No.: 358,239

[22] Filed: Mar. 15, 1982

Related U.S. Application Data

[63] Continuation-in-part of Ser. No. 142,871, Apr. 23, 1980.

[51] Int. Cl.[3] ..... E21D 11/00; E21B 7/00

[52] U.S. Cl. ..... 405/303; 173/43; 405/259; 405/288

[58] Field of Search ..... 405/259, 260, 303, 288; 173/22, 23, 34, 36, 43

[56] References Cited

U.S. PATENT DOCUMENTS

| | | | |
|---|---|---|---|
| 2,217,674 | 10/1940 | Curtis | 173/43 X |
| 2,316,672 | 4/1943 | Curtis et al. | 173/43 X |
| 2,318,595 | 5/1943 | Curtis | 173/43 |
| 2,334,576 | 11/1943 | Osgood | 173/43 X |
| 2,581,667 | 1/1952 | Joy | 173/43 X |
| 2,586,773 | 2/1952 | Ball . | |
| 2,610,029 | 9/1952 | Moon | 173/22 X |
| 2,646,968 | 7/1953 | Curtis | 173/23 X |
| 2,657,017 | 10/1953 | Curtis | 173/43 X |
| 2,665,117 | 1/1954 | Ivey | 173/23 |
| 2,718,118 | 9/1955 | Benjamin | 173/36 X |
| 2,730,332 | 1/1956 | Hale | 173/147 |
| 2,741,461 | 4/1956 | Joy | 405/259 X |
| 2,811,335 | 10/1957 | Fletcher et al. | 173/36 X |
| 2,958,514 | 11/1960 | Lee | 173/22 X |
| 3,028,922 | 4/1962 | Hudnall, Jr. | 173/22 X |
| 3,078,932 | 2/1963 | Nixon | 173/43 X |
| 3,124,204 | 3/1964 | Hudnall, Jr. et al. | 173/43 X |
| 3,165,157 | 1/1965 | Carbert | 173/23 X |
| 3,205,951 | 9/1965 | Pyles | 173/43 |
| 3,427,811 | 2/1969 | White | 405/259 |
| 3,612,190 | 10/1971 | Wills | 173/23 X |
| 3,834,761 | 9/1974 | Ray et al. | 175/85 X |
| 4,046,209 | 9/1977 | La Casse | 173/22 X |
| 4,234,155 | 11/1980 | Destree | 173/43 X |

FOREIGN PATENT DOCUMENTS

| | | | |
|---|---|---|---|
| 2906155 | 8/1979 | Fed. Rep. of Germany | 173/81 |
| 660369 | 11/1951 | United Kingdom | 173/43 |
| 1492735 | 11/1977 | United Kingdom | 173/43 |

*Primary Examiner*—Dennis L. Taylor

*Attorney, Agent, or Firm*—Laurence R. Brown

[57] ABSTRACT

An electric power actuated rubber tired carriage having a height profile substantially that of the tires on the wheels includes machinery for universally positioning in three separate degrees of motion a rotatable auger for drilling holes into mine tunnel walls. The drill rig comprises a square boom of variable length with a reciprocating auger mount with motor journalled thereabout to extend a parallel disposed drill of substantially the same length from the end of the boom into the drill hole. A power line retraction feature prevents fowling with drill rig movement. The rig carriage is short enough in length for transverse positioning across a tunnel width to drill holes at an acute angle to the ceiling wall for example, and bracing is mounted in these holes for supporting the ceiling. The drill is anchored in the tunnel floor.

4 Claims, 8 Drawing Figures

FIG.7
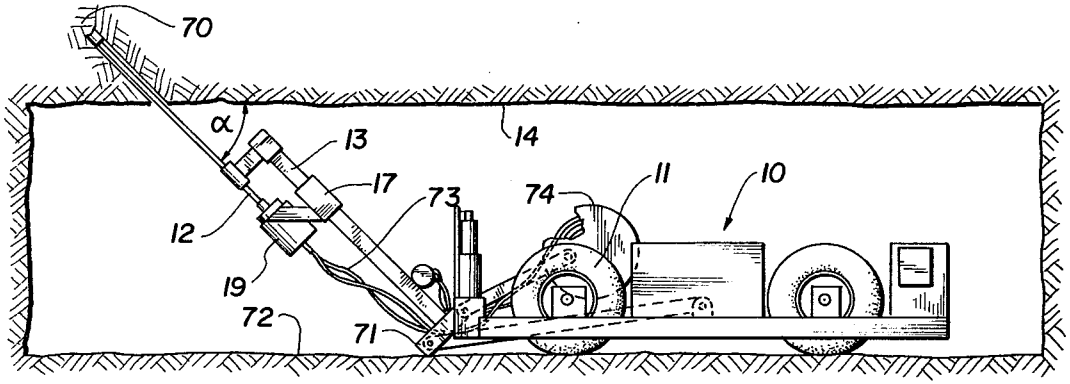
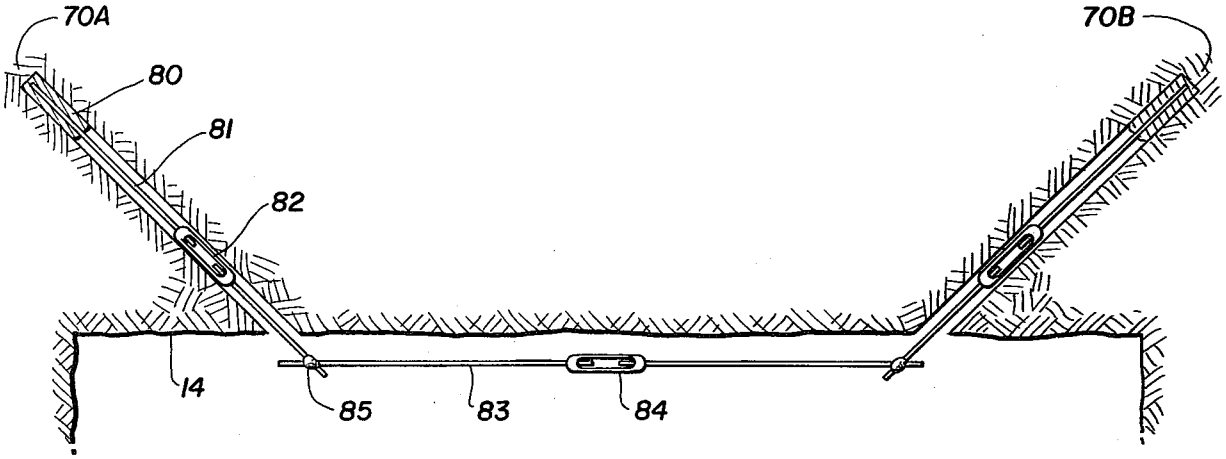
FIG.8

UNIVERSALLY POSITIONABLE LOW PROFILE MINE DRILLING MACHINE AND METHOD

This is a continuation-in-part of my copending application Ser. No. 142,871 filed Apr. 23, 1980.

TECHNICAL FIELD

This invention relates to machinery for drilling holes in mine tunnels in underground mine locations where space and maneuverability is limited, and more particularly it relates to versatile low profile, short wheelbase, self-contained mine drilling rigs maneuverable in low ceiling tunnels for drilling holes into the tunnel walls and bracing the walls thereof.

BACKGROUND ART

Although drilling machinery for mines is well known in the prior art, because of very limited overhead space in coal mines it has been difficult to develop acceptable drilling equipment for placing explosives on both bottom and top of the tunnel facing parallel to the floor and roof as required to blast away the tunnel facing for removal of the facing in a pattern extending the mine tunnel shaft walls substantially in the same dimension without manual working, cutting or shaping of residual layers. This is in part because the placement of explosive charges such as dynamite sticks requires drilled holes up to about ten feet in depth located at special angles and positions in the mine wall facing at the end of the mine tunnel and in particular in positions extending the floor and ceiling lines. Special equipment is required for coal mines where a shaft is about twenty feet (6.1 M) wide and may be as low as two feet (0.61 M) high. This leads to the necessity for hand drilling particularly to provide a clear extension of the tunnel at the mine face which need be accomplished by placing charges adjacent the roof and floor into the face.

Thus, it has been difficult for many prior equipments to maneuver into desired locations for drilling at various angles. The usual equipment is not even usable in coal mines because of the large size and limited space to work and cannot be used to drill at desired positions for example into the mine face level with the mine tunnel floor. This has occurred because of ruggedness and size with which the equipment has been built in the past, because of high profile carriages or associated mechanisms, and because of limitations in positioning imposed by particular mechanisms and construction features inherent in prior art machines.

It is therefore an object of this invention to simplify mine drilling equipment without reducing performance and to make it more adaptable for universal positioning within coal mine tunnels where head space is very limited to place drill holes adjacent the floor and ceiling and at any other desired angles and locations on the mine facings, walls or ceilings.

The following U.S. patents typically display such prior art equipment having the aforesaid problems.

V. H. Nixon—U.S. Pat. No. 3,078,932—provides an auger holding array that limits its positioning so that it cannot be used to drill holes adjacent to and parallel with the floors or walls of an existing tunnel. Thus, framework structure for holding the auger and operating mechanisms such as hydraulic cylinders are disposed between the auger and the floor or wall of a mine so that it is not feasible to drill a hole in the end wall of a mine tunnel adjacent to floor or sidewall level and parallel with it. Furthermore the mountings and chassis mount are not adaptable for use in coal mine shafts with a height under about six feet. Thus, the equipment is not versatile enough to lay the charges in positions required in coal mine tunnel positions.

In C. F. Ball—U.S. Pat. No. 2,586,773—Feb. 26, 1952—a manually positioned auger is swivel joint mounted to extend from a telescopic boom. Similarly C. F. Osgood—U.S. Pat. No. 2,334,576—Nov. 16, 1943 shows such a pivoted boom assembly. It is most important that there is developed by a rotating drill a significant rotary torque component which makes an auger difficult to place, direct and handle precisely. This type of assembly has no effective way to remove this undesirable torque from the delicate pivot assembly.

Thus the drill equipment must be large and heavy and need be manually directed and pivot clamps locked. In order to assist manual positioning a counterbalance is provided to help pivot a heavy drill boom assembly which has a motor, a feed mechanism and an auger all linearly disposed to swing from the pivot point. In coal mines with limited head room the manual placement of the drill at starting position is not feasible.

L. W. Ray et al.—U.S. Pat. No. 3,834,761—Sept. 10, 1974—is a type of carriage mounted low profile large diameter auger for removing coal from mines, but is not useful in positioning a drill bit at any desired location in a mine shaft facing.

J. C. Curtis—U.S. Pat. No. 2,217,674—Oct. 15, 1940; J. C. Curtis et al.—U.S. Pat. No. 2,316,672—Apr. 13, 1943; and J. C. Curtis—U.S. Pat. No. 2,657,017—Oct. 27, 1953—provide a carriage mounted drill reciprocally movable along a boom which is positionable in a swinging path by means of a hydraulic cylinder and lever linkage system. This type drill rig does not provide low profile operation and cannot for example drill holes in a low height coal mine tunnel face at the floor level because of required undercarriage for resting on the tunnel floor and the inability to position the bit contiguous to the floor.

All of this prior art is deficient in drilling operations at low profile in the coal mine environment without manual manipulation and placement of the drilling head to place charges exactly where necessary to extend the mine shaft without further cutting and shaping, namely among other locations to drill parallel to and adjacent the floor and ceiling.

In particular, if holes are desired in the walls of a mine tunnel at an acute angle to the walls, such as for the mounting of wall support braces, the prior art has not provided self contained rigs that could be maneuvered across the tunnel width and position the drill to drill the holes without manual assistance.

DISCLOSURE OF THE INVENTION

This invention provides powered drilling machinery specifically adapted for use in coal mine tunnels of limited height for drilling holes for dynamite charges in any position including those adjacent the tunnel floor into the tunnel end facing.

Thus, a low profile traction carriage with an overall height limited by its rubber tires to as little as two feet (0.61 M) can enter a mine tunnel to extend therefrom a boom carrying a rotatable drill in various degrees of movement, with structure positioning the drills contiguous to the floor of the mine tunnel for drilling holes into the facing at the end of the tunnel. Accordingly, explosive charges can be positioned universally to shoot out from the solid an extended tunnelway of almost identical dimensions without the necessity of shaping or squaring with a coal cutting machine or by hand.

The traction carriage is supplied with electrical lines to power a hydraulic source for operating cylinder jacks and rotary motors for positioning and drilling.

The drilling auger is carried underside a square quadrilateral shaped hollow steel boom of about ten feet (3 M) in length and three inches (7.6 cm) thick, by a hanger assembly so that it can project from the carriage with the auger parallel to and substantially contiguous with the floor.

Three pivot movements actuated by hydraulic jacks respectively provide for lateral and vertical swing and increased height above the carriage.

Further objectives, features and advantages of the invention will be found throughout the following description, claims and drawings.

BRIEF DESCRIPTION OF THE DRAWING

In the drawing:

FIG. 7 shows the drill rig provided by this invention transversely positioned across a mine tunnel width while drilling holes in the tunnel walls at an acute angle $\alpha$ thereto; and FIG. 8 shows the wall bracing support members in place as effected by the drilling rig and drilling methods provided by this invention.

DESCRIPTION OF A PREFERRED EMBODIMENT

Figure 1:
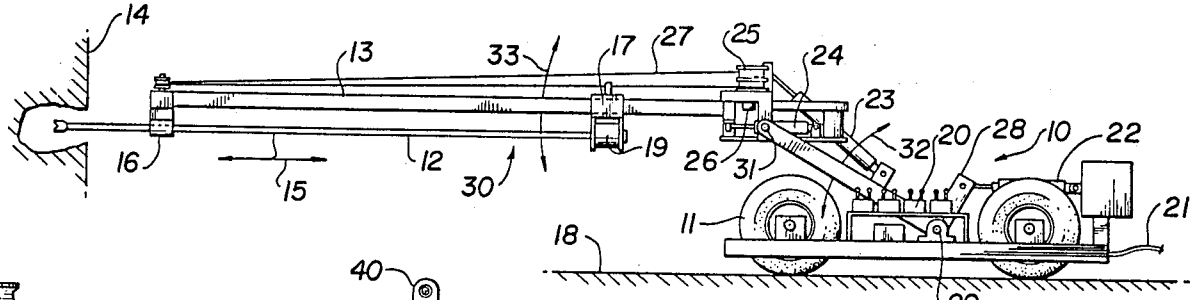
FIG. 1 is a side profile sketch of the mining machine with a drill rig elevated and partially extended.

As may be seen in side view in FIG. 1, the mining machine afforded by this invention comprises a low profile traction carriage 10 limited in height by the rubber tire 11 diameter. The carriage 10 thus can enter a low ceiling mine shaft of less than thirty inches (0.76 cm) and manipulate therein into any desired position a drilling auger 12 positioned underneath and parallel with boom 13.

The carriage 10 and boom 13 is held stationary by conventional brakes on the carriage with the auger 12 in position to drill into the mine tunnel face 14. This auger 12 is reciprocably movable as shown by arrow 15 through hanger bearing 16 and by means of bracket 17 movable along the length of the boom 13 to extend the auger typically ten feet (3.05 M) into the facing 14. Thus, the boom 13 and auger 12 are substantially coextensive in length and parallel. The lowermost position of the auger is substantially contiguous to the mine floor 18 as limited by the size of the rotary drive motor 19, hydraulically or electrically actuated from a power system 20 carried by the carriage 10 and derived from electric energy supplied by cable 21.

Suitable electric drive motors can be used for positioning the carriage 20, and conventional electric driven hydraulic means is included in the power system 20 for driving hydraulic jacks 22, 23 and 24 under control of an operator from a control panel which permits relative positioning of various pivot members actuated thereby.

Preferably the winch 25 is rotated reversibly by a hydraulic motor 26 driven from a hydraulic supply line with a relief valve therein to recirculate hydraulic fluid when pressures exceed a threshold level picked for optimum drilling speed into the facing 14. This winch 25 with cable 27 serves to reciprocate the auger by moving the bracket 17 along the outer rectilinear square surface of the boom 13 as a bearing surface. Note that the winch 25 is shown for purpose of illustration vertically above the boom 13 but may likewise be mounted laterally to preserve vertical height, if desired. This square surface on boom 13 with mating bracket 17 prevents any misadjustments or misplacements of the auger 12 which could occur because of rotational torque, serving as a simple mechanical brace structure.

The auger 12 is shown drilling at an elevated position on the facing 14, which is attained by means of hydraulic jack 22. This permits a simple mechanism such as L-shaped arm 28 pivoted at 29 to be rotated by jack 22 to lift the drill rig assembly 30 as pivot pin 31 is raised upwardly as the arm 28 moves about arc 32.

Figure 2:
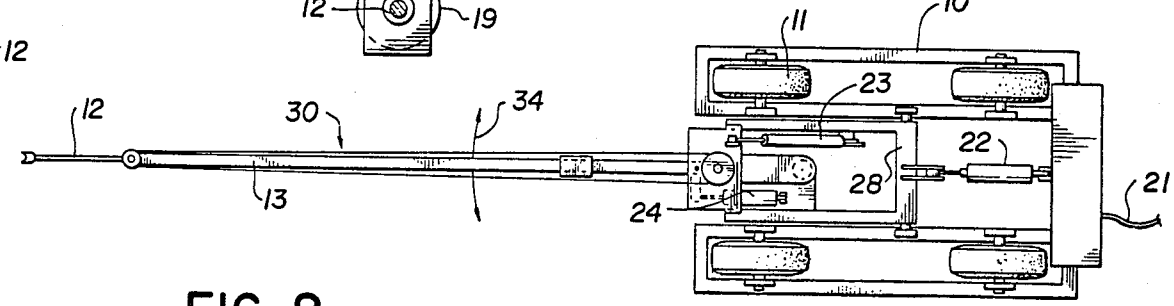
FIG. 2 is an plan sketch of the mining machine.
Figure 4:
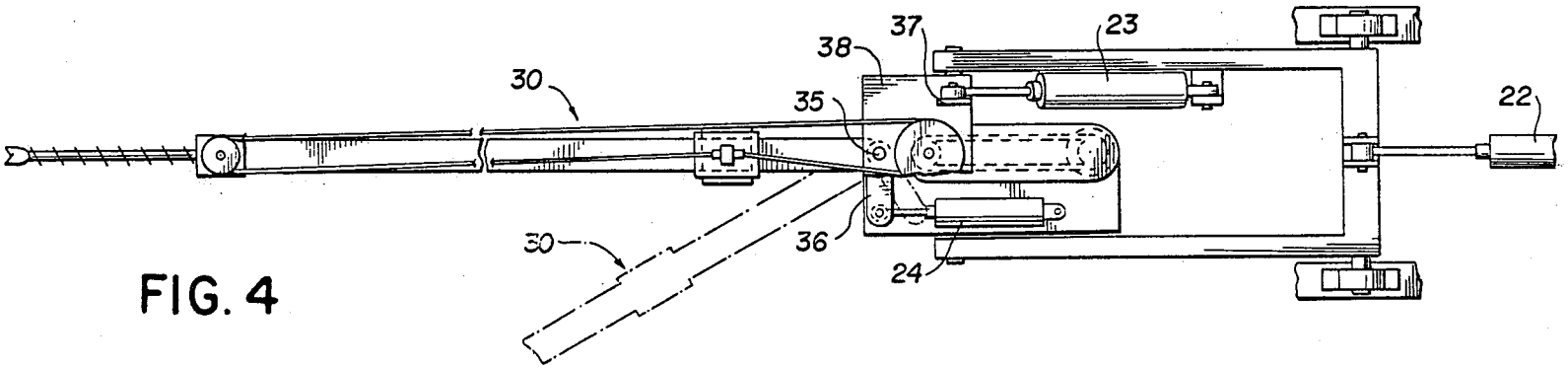
FIG. 4 is an enlarged partial plan view showing in phantom view the drill rig in horizontally pivoted position.

A further degree of vertical pivoting of the drill rig 30 is afforded by hydraulic jack 23 which thereby moves the rig 30 over arc 33. Similarly, as better seen from FIG. 2, there is also a lateral or horizontal degree of pivot movement imparted to the drill rig 30 by means of hydraulic cylinder jack 24 as signified by arc 34. This horizontal degree of movement afforded by pivoting the drill rig 30 about pivot pin 35 by means of lever am 36 actuated by hydraulic cylinder jack 24 is more clearly seen from the phantom view of FIG. 4. Also the vertical pivot mechanism is shown comprising hydraulic cylinder jack 23, lever arm 37 and platform 38.

Figure 3:
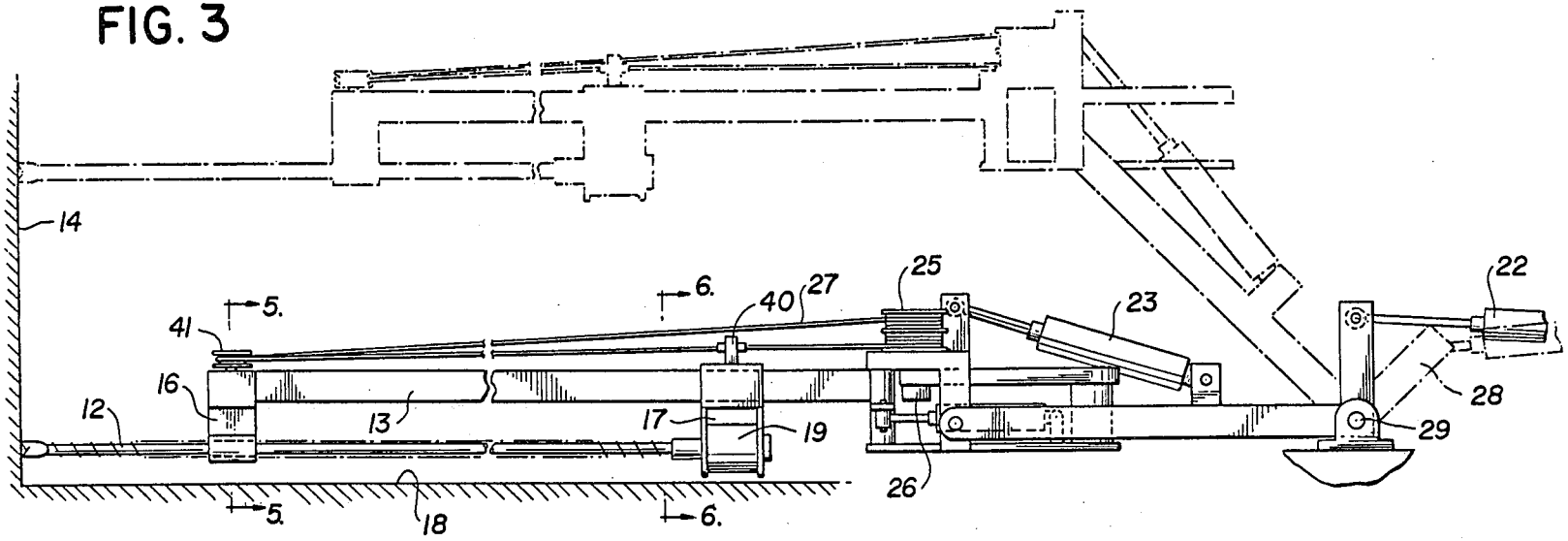
FIG. 3 is an enlarged partial side view showing the simplified drill positioning mechanisms afforded by this invention with the drill rig elevated in phantom view.

As may best be seen from FIG. 3, this mechanism resolves the critical requirement that blast holes need be drilled in the mine shaft facing 14 as near to the floor 18 as feasible. Thus, because hangers 16 and 17 mount the auger 12 below the single element square hollow boom 14, the light weight assembly is easily moved into various positions and angles, including vertical for drilling into mine shaft roofs, and yet without limitation to the position where the auger 12 is contiguous to floor 18 and parallel therewith, limited only by the motor structure 19, for rotating the auger.

The phantom view is that shown in FIG. 1 as attained by elevation of the drill rig 30 by means of hydraulic jack cylinder 22 and corresponding lever arm 28 extending from pivot pin 29.

FIG. 3 also best shows the drill extension means, namely winch 25, cable 27 and bracket 17. Thus it is seen that bracket 17 tab 40 is affixed to opposite ends of the cable 27 as wound on winch 25 so that reversal of winch rotation by means of motor 26 will cause the bracket 17 to move in opposite directions to either force the drill into the facing 14 or to retract it. The front idle roller 41 will permit the bracket 17 to move back and forth along the entire boom 13 length and thus extend auger 12 to drill a hole substantially the length of boom 13.

Figure 5:
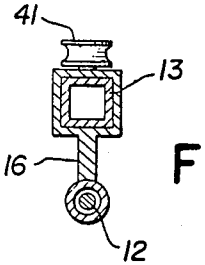
FIG. 5 is a section end view taken along lines 5—5 of FIG. 3 showing boom and drill construction details.

As shown in FIG. 5, the boom 13 is a hollow square metallic shaft about which is affixed by welding, screws or the like at its outer end the bearing bracket member 16 which journals the auger 12 for rotation therein. The square shaft and mating bracket 16 holds the auger 12 in a steady position even when rotating since it does not permit the accompanying torque to twist or bend the boom shaft.

Figure 6:
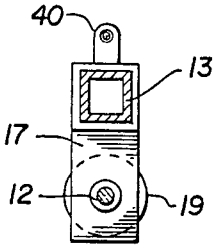
FIG. 6 is a partly section end view of a hanger assembly movable along the boom for retaining and reciprocably positioning the drill bit underneath the boom so that it can rest substantially on the floor, as shown along lines 6—6 of FIG. 3.

This same feature results in the moving bracket 17 journalled about square boom 13 to slide thereupon as a bearing surface, as seen from FIG. 6. This bracket 17 journals the auger 12 for rotation and holds the motor 19 as a mount. Thus the cable 27 attached to tab 40 will serve to reciprocate the drill to extend and retract it during and after drilling.

The hydraulic or electric controls 20 (FIG. 3) are of a conventional type to control the respective jacks and motors for establishing drilling direction and drill rig 30 position and to rotate and insert the auger.

It is to be recognized that the simplest mechanisms are employed to give versatile universal control of drill position in very limited space and that this construction permits drilling into the mine shaft facing at ground level. All of this is achieved together with power driven positioning and drilling so that it is not necessary for manual placement of the auger in any manner other than manipulation of a control panel or for assist in drilling. Also it is evident that this machine permits universal drill hole placements for shots extending a mine shaft without cleaning out the shot area after a shot by cutting or shaping.

Not only is drilling required in mine tunnels for placement of shots but also for shoring up and bracing the walls, particularly the ceiling wall, to prevent cave in and erosion. This is particularly true in coal mines where the tunnel walls are not carved out of solid rock. Thus, FIGS. 7 and 8 illustrate the particular problems and conditions involved in bracing mine walls and the equipment and method that afford solutions to these problems of this invention. In these embodiments, similar reference characters will illustrate similar features for ready comparison. Details shown heretofore which would obscure the nature of these advances, are omitted as redundant.

The tunnel cross section with walls 14 is typically about one meter high and six meters wide. The drilling rig carriage 10 has a low profile height of about 0.6 meters, a length of about two meters and a weight of about 1 ½ tons. It is a critical dimension that the wheelbase of the rig carriage 10 be shorter than the tunnel width to permit the rig to be placed transversely in the tunnel as shown and thereby also to permit the boom 13 extending from the front wheel set 11 of the rig carriage 10 to be transversely positioned across the tunnel width.

Other critical features are shown which permit the self contained rig carriage 10 to position without manual assistance the drill 12 with its accompanying motor 19 for drilling the angular hole 70 in the ceiling wall 14 for the bracing of the tunnel as shown in FIG. 8. One of these features is the anchor brace comprising the terminal socket member 71 at the lower end of the boom 13 which engages the mine tunnel floor 72 to counteract the drilling force provided when the motor 19 is moved toward hole 70 in the drilling operation.

With this feature, the boom 13 is positioned across the width of the tunnel in the manner hereinbefore explained by the self contained mechanisms carried by the rig carriage 10, with its drill end disposed to direct the drill 10 into the ceiling wall 14 at the acute angle $\alpha$ and with the other end anchored by the terminal socket member 71 on the floor 72 of the tunnel. Thus, the motor 19 can be forced outwardly on the boom 13 to drill hole 70 with the counteracting force absorbed by the tunnel floor 72 rather than the carriage 10. This more precisely locates the drill 12 and prevents its bending, etc. from force on the pneumatic tires 11, or tilting the carriage, etc. The anchoring may not be necessary for the straight, horizontal or vertical holes hereinbefore discussed, but is available if necessary.

The boom member 13 in FIG. 7 is shorter than that in FIG. 1, for example 1.2 meters. Thus, the terminal socket member 71 permits exchange and lock in place of the drill 12, boom member 13, motor 19 combination of different lengths with quick changeover. Thus, the power feed lines 73 are of the plug in type whether they be electric or pneumatic to feed power to the drill rotating motor 19.

Because motor 19 and the bracket sliding means 17 moves along boom 13 and thus a variable length of power feed line 73 is necessary, retraction means 74 is provided to reel up the line with a predetermined degree of tautness, thereby to prevent interference in the rigging, etc. as the carriage is moved. Thus, the power supply lines are stored and released automatically as the motor 19 position changes along the length of the boom member 13.

As may be seen from FIG. 8, two separated holes 70A and 70B are drilled on opposite sides of the ceiling wall 14 as effected by turning the drill rig carriage 10 around in the tunnel. The two holes 70A and 70B converge in the direction of the tunnel.

Then fastener plugs 80, such as threaded nuts, are securely affixed in the holes by cementing, or the like. The variable length rods 81, adjustable by turnbuckle 82 for example, are then fastened into the plugs 80 such as by threading thereinto. They extend at the lower end out into the tunnel.

The two rods 81 are connected together with a third adjustable rod 83, having a turnbuckle 84 for example, by welding at joints 85. Then the turnbuckle can be manipulated to adjust (shorten) the rod lengths thereby to securely brace the ceiling wall in place and minimize the risk of collapse.

Thus the equipment and features provided by this invention facilitate the bracing of tunnel walls requiring angular transverse drill holes. The holes are thus drilled by a self contained drilling rig without requiring manual assistance other than manipulation of mechanism controls in the drilling of such holes and thus greatly increases the mine shaft safety by reducing cost and time required to install wall bracing.

Having therefore set forth improved methods and equipment, those features of novelty believed descriptive of the spirit and nature of the invention are defined with particularity in the claims.

INDUSTRIAL APPLICATION

A low profile drilling machine is provided for entry into low height coal mine shafts to drill into the facing for placing dynamite or other explosive shots. This machine has the features of universal placement of the drilled holes from various angles and levels and the adaptability to drill holes substantially at floor level, which heretofore were done by hand operated drills.

The machine is operated from electric power which energizes a hydraulic power source for positioning the drill head and operating motors such as required for rotating augers.

Thus, there is provided a fully mechanized drilling machine which is operated manually only by controlling the hydraulic and electrical power to the various motor and moving mechanisms included.

This machine permits proper placement of explosive shots such that the mine shaft face can be blown out without requiring any significant after cutting or shaping.

Also the mobile carriage drilling rig is short enough to be positioned transversely in a mine tunnel to drill angular holes for bracing the ceiling walls.

I claim:

1. The method of bracing the walls of a mine tunnel having a floor and walls defining a tunnel cross section of a predetermined height and width, by mounting support members in holes drilled at an acute angle to the tunnel walls, comprising the steps of, (a) entering a steerable low profile mine drilling rig with a height less than the tunnel height and supported by two sets of rubber tired wheels with a wheelbase shorter than the tunnel width into the tunnel and supporting the rig on its rubber tires, (b) extending from a position between the wheels of one wheel set a boom member of predetermined length to fit with said rig across the width of said tunnel carrying a drill movable along the length of the boom generally perpendicular to the wheel set and positionable at various angles relative to the tunnel walls by a mechanism carried by said rig, (c) orienting the drilling rib transversely in the tunnel with the boom member directed generally across the width of the tunnel and manipulating the boom by means on the rig providing direction and support for the boom in a selected position to direct a drill into the walls, (d) positioning the boom member with one end disposed to direct the drill into a wall at said angle, (e) anchoring the other end of the boom from the drill on the floor of the tunnel to counteract drilling force, and (f) drilling the holes at said angle into the walls for mounting the support members with the boom member anchored to the floor.

2. Drilling apparatus for providing a longer drill depth within given confines of a mine tunnel when bracing the walls of a mine tunnel having a floor and walls defining a cross section of a predetermined height and width by mounting support members requiring holes drilled at acute angles to the tunnel walls, comprising in combination, a low profile mine drilling rig having two sets of rubber tired wheels with a wheelbase shorter than the tunnel width and a height less than the tunnel height supporting the rig, a boom member of predetermined length to fit with said rig into said tunnel extending generally perpendicular from one wheel set carrying a drill generally coextensive in length with the boom member and positionable by a mechanism carried by said rig to be held firmly in a position directing the drill into a tunnel wall, means carried by the rig for orienting the drilling rig with the boom member across the width of the tunnel with one end disposed to direct the drill into a wall at said angle and with the other end supported in a terminal member, means for positioning the drill end to move from the terminal member in a generally coextensive position alonside the boom to an extended position from the end of the boom, means adapting said terminal member as an anchor on the floor of the tunnel to therefore permit the full length of the drill and boom to extend from the floor with the anchor counteracting drilling force, and means carried by the rig for operating the drill with the boom member anchored to the floor to drill said holes to a predetermined depth up to substantially the length of the boom member, thereby to provide increased drilling depth by mounting the drill end terminal on the floor of the tunnel.

3. Apparatus as defined in claim 2 with a socket in said terminal member for removably receiving and locking in boom members and associated drills of various lengths.

4. A low profile self contained mine tunnel drilling rig for entering a mine tunnel with a floor and positioning the drill toward a tunnel wall to firmly support the drill for drilling holes in the walls of the tunnel, comprising in combination, an anchor member positionable by mechanisms carried by the rig to rest on the tunnel floor adjacent the rig, socket means in said anchor member receiving and supporting a longitudinal boom member carrying therealongside a drill extendible along the entire length of the boom and accompanying drill rotating motor with the boom substantially on the floor, and means forcing the drill into the walls of the tunnel by moving the drill and drill motor along the boom member, whereby the anchor member resting on the floor will counteract drilling force as the drill is forced into the walls of the tunnel and the drilling depth is increased in a tunnel of any given size because the drill length extends from the floor to the end of the boom.

* * * * *